United States Patent [19]

Nakazawa

[11] Patent Number: 4,657,405

[45] Date of Patent: Apr. 14, 1987

[54] STOP WATCH CAPABLE OF INDICATING A PLURALITY OF SPLIT TIMES

[75] Inventor: Eiji Nakazawa, Tokyo, Japan

[73] Assignee: Casio Computer Company, Ltd., Tokyo, Japan

[21] Appl. No.: 897,290

[22] Filed: Aug. 15, 1986

[30] Foreign Application Priority Data

Aug. 28, 1985 [JP] Japan ..... 60-188777

[51] Int. Cl.[4] ..... G04F 8/00

[52] U.S. Cl. ..... 368/110; 368/113

[58] Field of Search ..... 368/102, 107–113

[56] References Cited

U.S. PATENT DOCUMENTS 4,211,066 7/1980 Kusumoto et al. ..... 368/113

4,523,857 6/1985 Ushikoshi ..... 368/107

4,537,514 8/1985 Moriya ..... 368/107

*Primary Examiner*—Vit W. Miska

*Attorney, Agent, or Firm*—Frishauf, Holtz, Goodman & Woodward

[57] ABSTRACT

In a stop watch, when a switch is depressed, hands are operated to start timing. Every time a split time switch is depressed, the time intervals between time points at which the split time switch is depressed are sequentially stored in a memory. Therefore, when the switch is re-depressed, the stop watch terminates its time measurement. A plurality of split times up to the end of time measurement can be reproduced, from the latest split time to the earliest split time.

13 Claims, 6 Drawing Figures

STOP WATCH CAPABLE OF INDICATING A PLURALITY OF SPLIT TIMES

BACKGROUND OF THE INVENTION

The present invention relates to an analog type stop watch which can measure the time from the starting to the stopping of a start/stop switch, display measurement data by means of hands, and further, display a plurality of split times as elapsed times.

Generally, in sports competitions wherein a plurality of players compete for speed, such as track-and-field and swimming, the finishing times of the respective players must be recorded in the order of their arrival. When a single person measures the elapsed times of the plurality of players, he necessarily uses a single stop watch to measure their respective finishing times. As examples of stop watches of this type, digital type stop watches are known. More specifically, a digital type stop watch of this type has a counter for measuring the elapsed time since the start, a start/stop switch, and another switch for recording the elapsed time since the start (generally called "elapsed time" or "split time"; to be referred to as "split time" in the present specification). Every time the split time recording switch is depressed, the content of the counter at that time is stored in an electronic circuit. To display the split time, data stored in the electronic circuit is displayed on a digital display means after measurement.

In other words, with digital type stop watches, if an electronic circuit for storing data during measurement is provided, arbitrary measurement data can be selectively displayed instantaneously. As described above, a split time stored in the electronic circuit is not displayed after measurement. Therefore, it is easy for a digital type stop watch to display a split time for a predetermined period of time when the switch is depressed, allowing the operator to write the displayed time on a sheet of paper or the like. Thereafter, the stop watch is instantaneously switched to display the present time being measured since the start, and is prepared for the next measurement.

In contrast to this, since conventional analog stop watches perform display mechanically, or geometrically, they cannot be instantaneously switched, in order to display different measurement data. Accordingly, they can merely measure the time from start to finish, and do not allow confirmation of a plurality of split times during or after measurement. When the operator wishes to know a split time, he must read the momentary positions of moving hands, resulting in erroneous reading.

U.S. Pat. No. 4,211,066 entitled "STOP WATCH" by Kusumoto describes a stop watch wherein the above drawbacks are eliminated and the hands of a stop watch are stopped to display a split time. More particularly, according to the technique of this U.S. Patent, when a switch of a stop watch is depressed to obtain a split time during measurement, the hands are stopped, and the timer unit is operated to measure the time period during which the hands are stopped. When the switch is reactivated, the hands are moved or shifted quickly to compensate for the time during which they have been stopped.

With the technique of this Patent, however, each elapse time can be displayed only once and the next elapse time can be obtained only after the hands are moved by the quick-shift operation. As a result, the stop watch operation becomes considerably complex. In addition, when differences among the respective split times of a plurality of persons are small, such split times cannot be measured.

The unit of measurement of a stop watch is 1/100 or 1/10 second, and thus is very short. If a pulse shorter than such a unit of measurement is applied to move the hands of a stop watch to catch up with the present time measured from the start, it may damage the mechanism of the watch by the force of its drive torque. In addition, when a split time is displayed for a long period of time and is then canceled, it takes considerable time for the hands to catch up with the present time being measured, and the next split time cannot be measured. Furthermore, once measurement of all the split times is finished, each of them cannot be displayed again. Therefore, each split time must be written down in record paper during measurement, resulting in inconvenience.

SUMMARY OF THE INVENTION

The present invention has been made in view of the above situation and has as its object to provide a stop watch which can easily measure a split time without applying a mechanical overload to its gear train mechanism, even if an interval between split times is short.

The object can be accomplished by providing a stop watch comprising a stepping motor, a hand drive mechanism coupled to said stepping motor for driving the hands of the stop watch, an oscillator for producing a reference signal, a stepping motor driving circuit for frequency-dividing the reference signal, so as to produce a signal for driving said stepping motor, a start/stop control circuit for controlling a supply of the stepping motor driving signal output from said stepping motor driving circuit to said stepping motor, a split time measurement switch for obtaining a plurality of split times by depressing the same a plurality of times while said stepping motor is driven under the control of said start/stop control circuit, time measurement means for measuring a time interval between successive split time points at which said split time measurement switch is depressed, to obtain time interval data, time interval data memory means for storing the time interval data measured by said time measurement means, and reproducing means for driving said stepping motor for a time period corresponding to the time interval data stored in said time interval data memory means while said stepping motor is stopped under the control of said start/stop control circuit, and for reproducing a split time point at which said split time measurement switch is depressed.

With this arrangement, although the stop watch of the present invention is of an analog type, it can confirm a plurality of split times after the measurement has been completed, resulting in great convenience.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
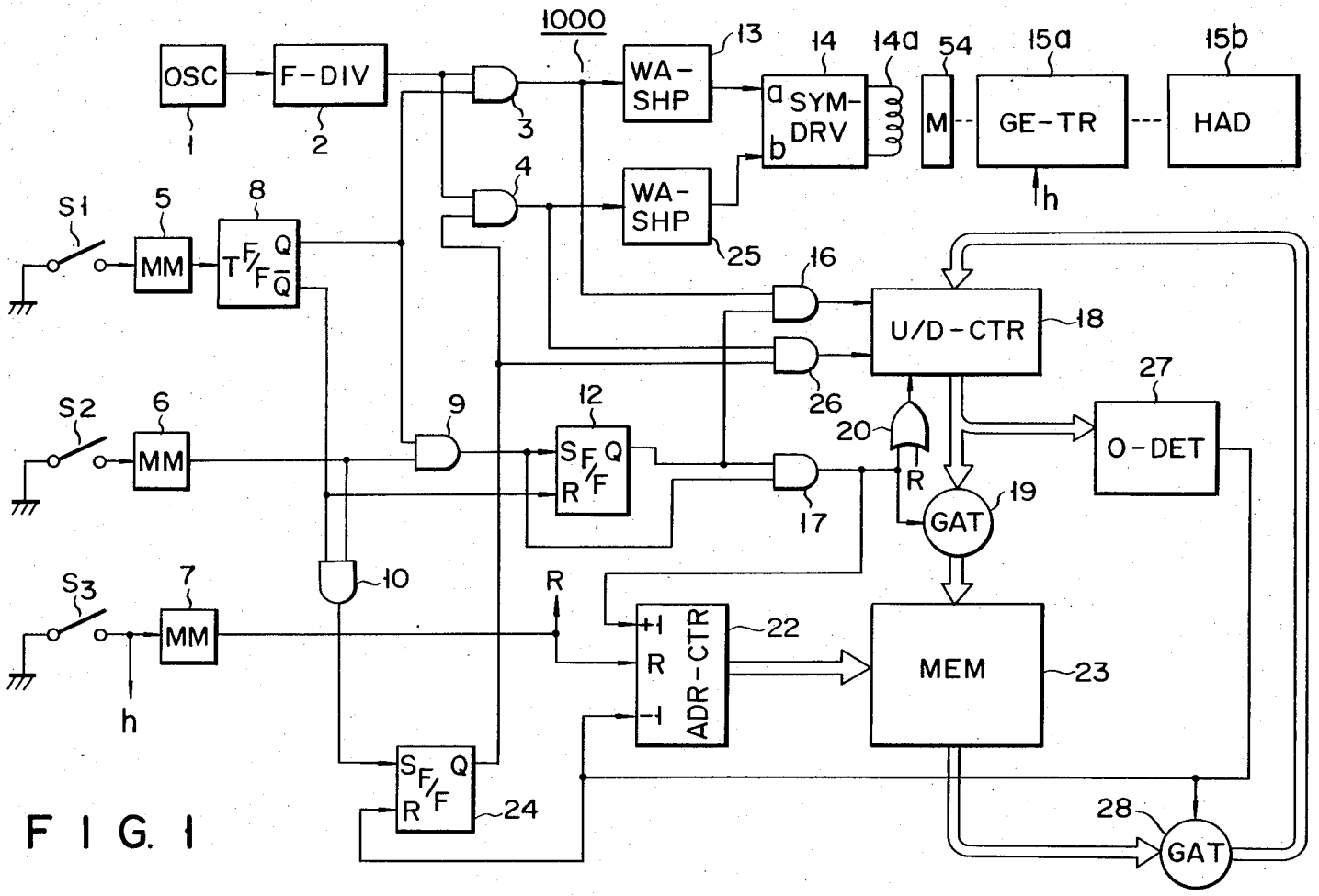
FIG. 1 is a circuit diagram of a stop watch according to an embodiment of the present invention.

FIG. 1 is a circuit diagram of stop watch 1000 according to the present invention. Referring to FIG. 1, oscillator circuit 1 oscillates a clock signal having a predetermined frequency. The output signal of oscillator 1 is frequency-divided by frequency dividing circuit 2, to a signal having a frequency of, for example, 100 Hz, and is supplied to both AND gates 3 and 4. Reference numerals S1, S2, and S3 denote manual switches. Switch S1 serves as a start/stop switch, switch S2 serves as a split time measurement switch, and switch S3 serves as an all-reset manual switch. The operation signals of switches S1, S2, and S3 are applied to corresponding one-shot (multivibrator) circuits 5, 6, and 7, respectively, to generate one-shot pulse signals. The pulse signal from one-shot circuit 5 is supplied to a T-input terminal of binary flip-flop 8, to invert its output state. The Q output signal (start signal) of flip-flop 8 is supplied to AND gates 3 and 9 as a gate control signal. The $\overline{Q}$ output signal of flip-flop 8 is supplied to AND gate 10 as a gate control signal, and to an R-input terminal (reset terminal) of flip-flop 12 as a reset signal. AND gate 3 receives the Q output signal of flip-flop 8 and supplies the 100-Hz signal from frequency-dividing circuit 2 to waveform-shaping circuit 13, as a clock signal. The 100-Hz signal waveform-shaped by circuit 13 is supplied to input terminal a of driving circuit 14. Upon recept of the 100-Hz signal, circuit 14 supplies a forward rotational signal to coil 14*a* of stepping motor 54, so that motor 54 enables the hands of the watch to move forward. Gear train mechanism 15*a* drives hand section 15*b*.

Figure 2:
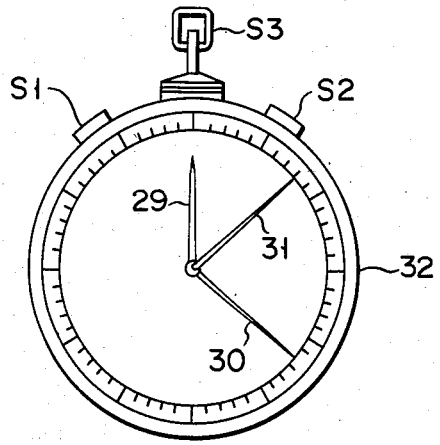
FIG. 2 is a front view of the outer appearance of the stop watch shown in FIG. 1.

FIG. 2 shows the outer appearance of the stop watch of the present invention. Minute hand 29, second hand 30, and 1/100 second hand 31 of section 15*b* which are moved by gear train mechanism 15*a*, are coaxially arranged in stop watch 1000. Switches S1, S2, and S3 are arranged on the side of case 32, to be capable of being depressed.

Referring back to FIG. 1, the pulse signal output from one-shot circuit 6 is supplied to an S-input terminal (set terminal) of flip-flop 12 through AND gate 9. The Q output signal from flip-flop 12 is supplied to AND gates 16 and 17 as a gate control signal. Gate 16 also receives the 100-Hz signal from AND gate 3. The 100-Hz signal from gate 16 is supplied to the UP input terminal of up-/down-counter 18 (a split time counter for obtaining split data), to up-count the split time. More particularly, upon receipt of the 100-Hz signal through gates 3 and 16, counter 18 starts split time measurement. When input of the 100-Hz signal is prohibited by gate 3 or 16, counter 18 stops split time measurement. Counter 18 can obtain arbitrary split time data by counting the number of 100-Hz signals supplied thereto. The pulse signal output from one-shot circuit 6 in response to depression of switch S2 for split time measurement, is supplied to gate circuit 19, OR gate 20, and the +1 terminal of address counter 22 through AND gates 9 and 17. Therefore, when circuit 19 is enabled, the split time data from counter 18 is stored at address "0" of memory 23. The count content (split time data) of counter 18 is cleared by the output signal of OR gate 20. Each output signal of AND gate 17 increments the address signal of counter 22 by one, so that the address of memory 23 is incremented in unitary increments from "0". In this manner, since the pulse for enabling gate circuit 19 and that for incrementing counter 22 are identical, the first content of counter 18 is stored at memory address 0 of memory 23, the second content of counter 18 is stored at memory address 1 of memory 23, and so on.

The $\overline{Q}$ output signal (stop signal) from binary flip-flop 8 is supplied to AND gate 10 as a gate control signal, and also to the R input terminal (reset terminal) of flip-flop 12, as a reset signal. More specifically, the Q output signal from flip-flop 12 is set to "L" (low) level, to disable AND gate 16, thereby stopping measurement by counter 18. When the Q output signal is generated from flip-flop 8, AND gate 3 is disabled as well, to prohibit output from waveform shaping circuit 13, thereby stopping hands 29, 30, and 31. Meanwhile, when the $\overline{Q}$ output signal from flip-flop 8 is set to "H" (high) level, and switch S2 is depressed (to measure/indicate a split time), AND gate 10 generates an output signal. The pulse output signal from one-shot circuit 6 is supplied, via AND gate 10, to the S input terminal (set terminal) of flip-flop 24. The Q output signal from flip-flop 24 is supplied to AND gates 4 and 26 as a gate control signal. Upon receipt of the gate control signal, AND gate 4 supplies the 100-Hz signal from frequency-dividing circuit 2 to waveform-shaping circuit 25. The 100-Hz signal waveform-shaped by circuit 25 is supplied to input terminal b of driving circuit 14. Circuit 14 supplies a signal to coil 14*a*, to drive gear train mechanism 15*a* in a reverse direction. The 100-Hz signal from gate 4 is also input to the DOWN input terminal of counter 18, through AND gate 26, and the content of counter 18 is counted down from its recorded split time count. When the content of counter 18 becomes 0, 0-detecting circuit 27 outputs a detection signal to gate circuit 28, the R-input terminal (reset terminal) of flip-flop 24, and the −1 terminal of address counter 22.

Then, the recorded content of memory 23 at the designated address is transferred to counter 18 through gate circuit 28. Counter 22 decrements the address, thereby decrementing the address of memory 23 (to serve as the address of preceding split time data). Subsequently, the detection signal from 0-detecting circuit 27 sets the Q output signal, of flip-flop 24, to "L", to disable AND gate 4, so that the output from waveform shaping circuit 25 is stopped, thereby stopping counter-clockwise movement of hands 29, 30, and 31 of hand section 15*b* through driving circuit 14 and gear train mechanism 15*a*. In this case, AND gate 26 is also disabled, so that no output signal is generated therefrom, and counter 18 performs down-counting.

Then, operation signal h from switch S3 is supplied to gear train mechanism 15*a*, to initialize all of hands 29, 30, and 31 of hand section 15*b* to 0. Signal h is also supplied to one-shot circuit 7, to generate a one-shot pulse signal. The pulse signal from circuit 7 is supplied to the R input terminal (reset terminal) of address counter 22, to designate its address number at 0. The pulse signal from circuit 7 is also supplied, via OR gate 20, to the R terminal of OR gate 20, to clear the counting content of up-/down-counter 18.

OPERATION OF STOP WATCH

The operation of the stop watch 1000 will now be described with reference to FIG. 3.

First, manual switch S3 is depressed for initialization. Then, signal h from switch S3, via gear train mechanism 15*a*, sets all of hands 29, 30, and 31 to "0". The pulse signal output from one-shot circuit 7 is supplied to counter 18, to clear it through OR gate 20, and address counter 22 is set at address "0". For example, assume that four players have started simultaneously and a person in charge of time measurement has depressed manual switch S1 of the stop watch. Upon doing so, an output pulse from one-shot circuit 5 sets the Q output signal, from binary flip-flop 8, to "H" level, to enable AND gate 3, and a 100-Hz signal from frequency-dividing circuit 2 is supplied to waveform-shaping circuit 13. Driving circuit 14 moves hands 29, 30, and 31 through gear train mechanism 15*a*. In this state, only hands 29, 30, and 31 move, up/down counter 18 does not perform the counting operation, the content thereof being 0, the address signal of address counter 22 is also 0, and nothing is recorded in memory 23. Thereafter, assume that a first player reaches the goal at 1'05"40 after the start, and split switch S2 is depressed. Then, the pulse output from one-shot circuit 6 passes AND gate 9, which is enabled by the "H" level Q output signal supplied from flip-flop 8, sets flip-flop 12, and sets the Q output signal, from flip-flop 12, to "H" level. The "H" level signal enables AND gate 16 and the 100-Hz signal is supplied, via gate 16, from AND gate 3 to up/down counter 18, thereby starting up-counting. In this case, hands 29, 30, and 31 keep moving, for time measurement. Now assume that a second player has made the goal 1"60 after the first player, and switch S2 is depressed again (hands 29, 30, and 31 indicate 1'07"00 at this time). The output pulse from circuit 6 then passes AND gate 9, which is enabled by the "H" level Q output signal from flip-flop 8, sets flip-flop 12, and sets the Q output therefrom to "H" level. The pulse output from gate 9 passes AND gate 17 which is enabled by the "H" level Q output signal from flip-flop 12, to enable gate circuit 19. Therefore, the content (1"60) of counter 18 is stored at address 0 of memory 23, and the address designation of counter 22 is incremented by one. The content (1"60) of counter 18, which is the last counted split time, is cleared. In this case, since the "H" level Q output signal of flip-flop 12 also enables AND gate 16, the 100-Hz signal is kept supplied, from AND gate 3 via AND gate 16, to cleared counter 18, thereby continuing up-counting. Now assume that a third player has made the goal 2"30 after the second player, and switch S2 is depressed again (hands 29, 30, and 31 indicate 1'09"30 at this time). In this case, the pulse output from circuit 6 passes AND gate 9, which is enabled by the "H" level output signal from flip-flop 8, to set flip-flop 12 and to set the Q output signal therefrom to "H" level. The pulse output from AND gate 9 passes AND gate 17 which is enabled by the "H" level Q output signal from flip-flop 12, enables gate circuit 19, in the same manner as described above, and the content of counter 18, i.e., 2"30, is stored at address 1 of memory 23. The address designation of address counter 22 is then incremented by one. The content (2"30) of counter 18 is cleared. Since the Q output signal from flip-flop 12 is kept at "H" level, it keeps AND gate 16 enabled, and the 100-Hz signal continues to be supplied to cleared counter 18, from AND gate 3, through AND gate 16, thereby continuing up-counting from 0. Now assume that a fourth player has finally made the goal 3"56 after the third player, and switch S1 as the stop switch is depressed. In this state, hands 29, 30, and 31 indicate the present time from the start, i.e., 1'12"86. The pulse signal output from one-shot circuit 5 inverts the output state of flip-flop 8, so that Q output thereof is set to "L" level and $\overline{Q}$ output thereof is set to "H" level. The "L" level Q output signal disables gate 3, to stop hands 29, 30, and 31 as they indicate the finishing time of the fourth player, i.e., 1'12"86, and flip-flop 12 is reset, to set its Q output to "L" level. Thus, AND gate 16 is disabled, and measurement by counter 18 is stopped at 3"56. Now assume that switch S2 as a split time switch is depressed to obtain the finishing time of the third player. Upon doing so, the pulse signal output from circuit 6 passes AND gate 10, which is enabled by the "H" level $\overline{Q}$ output signal from flip-flop 8, sets flip-flop 24, and sets the Q output thereof to "H" level. This enables AND gate 4, the 100-Hz signal from frequency-dividing circuit 2 is supplied to waveform-shaping circuit 25 through gate 4, and hands 29, 30, and 31 are moved counterclockwise by circuit 25 through driving circuit 14 and gear train mechanism 15*a*. In this case, the "H" level Q output signal from flip-flop 24 also enables AND gate 26. Therefore, the 100-Hz signal from frequency dividing circuit 2 is supplied, via gates 4 and 26, to counter 18, to command it to down-count. Since data 3"56 is stored in counter 18, counter 18 starts downcounting from this value. When the content of counter 18 reaches "0", 0-detecting circuit 27 outputs a detection pulse to counter 22, flip-flop 24, and gate circuit 28. First, circuit 28 is enabled, and the content (2"30) at address 1 of memory 23 is transferred to cleared counter 18 through a bus line or the like. Counter 22 decrements its address designation by one, and flip-flop 24 is reset to set its Q output to "L" level. AND gate 4 is thus disabled, the 100-Hz signal from frequency-dividing circuit 2 does not pass gate 4, the output from waveform-shaping circuit 25 is stopped, and the counterclockwise rotation of hands 29, 30, and 31 is stopped. At this time, hands 29, 30, and 31 indicate a time obtained by subtracting 3"56 from 1'12"86, as the finishing time of the fourth player, i.e., 1'09"30 (the finishing time of the third player). At this time, the time difference of 2"30 between the finishing times of the second and third players is transferred to counter 18 from memory 23, and is stored therein. Assume that switch S2 is then depressed, to obtain the finishing time of the second player. In the same manner as described above, hands 29, 30, and 31 are rotated counterclockwise until the content of counter 18, i.e., 2"30, is decreased to 0. When the content of counter 18 becomes 0, hands 29, 30, and 31 are stopped when they indicate 1'07"00 (the finishing time of the second player). In this case, the time difference 1"60 between the finishing times of the second and first players is transferred to counter 18 from memory 23, and is stored therein. Assume that switch S2 is depressed a final time, to obtain the finishing time of the first player. Hands 29, 30, and 31 are rotated counterclockwise in the same manner as described above until the content of counter 18, i.e., 1"60, is decreased to "0". When the content of counter 18 becomes "0", hands 29, 30, and 31 are stopped when they indicate 1'05"40 (the finishing time of the first player), and the content of counter 18 becomes "0" simultaneously. In this manner, after the split times of a plurality of players are measured, the hands are sequentially rotated counterclockwise, so that the finishing times of the respective players can be obtained with comparative ease.

In the above embodiment, the stepping motor is rotated in the reverse direction, so as to sequentially rotate the hands counterclockwise to positions indicating a time point at which split time switch S2 has been depressed. In other words, the hands are moved from the stop position (i,e., the finishing time) toward the starting position while they are in turn stopped at the respective split time positions. Conversely, if the hands are cleared, i.e., returned to a position indicating 0°00'00 and are sequentially fed quickly to positions indicating a time point at which switch S2 has been depressed, the stepping motor need not be rotated in the reverse direction. In this case, time period data from a time point at which switch S1 is depressed to a time point at which switch S2 is depressed for the first time, must be stored in memory 23. For this purpose, an OR circuit is provided between AND gate 9 and flip-flop 12, so as to receive an output signal from gate 9 and an initial operation signal from switch S1. When a split time is to be displayed, the time period data is read out from memory 23 in accordance with the order in which it is stored, and the hands are driven to move over a distance corresponding to the respective time period data.

Figure 3:
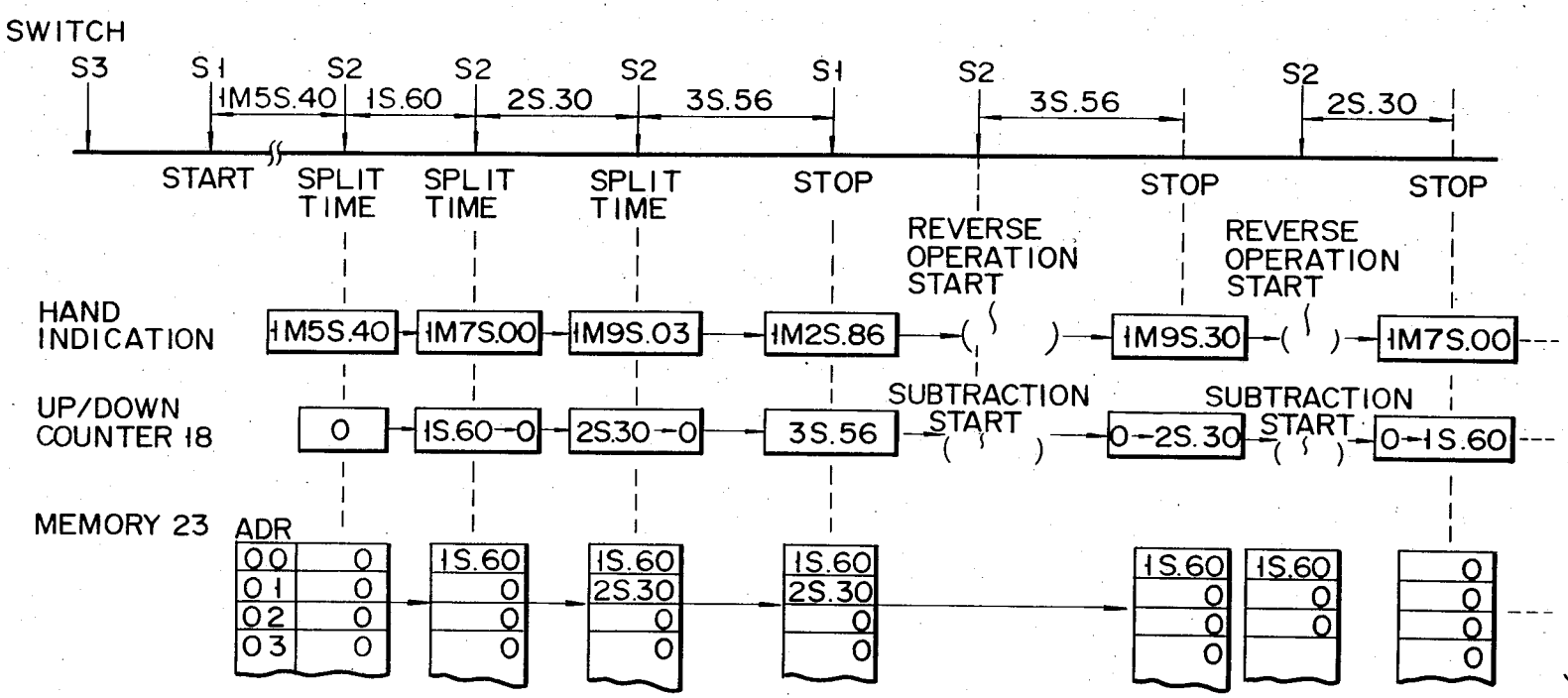
FIG. 3 is a view for explaining the operation of the stop watch shown in FIGS. 1 and 2.

In the above embodiment shown in FIGS. 1 to 3, the hands of the stop watch were started by depression of switch S1, and kept moving at a frequency of 100 Hz until they were stopped by re-depression of switch S1.

Upon depression of switch S2, if the hands were stopped at each respective split time as described in U.S. Pat. No. 4,211,066, the split time could be obtained then, resulting in great convenience.

Figure 5:
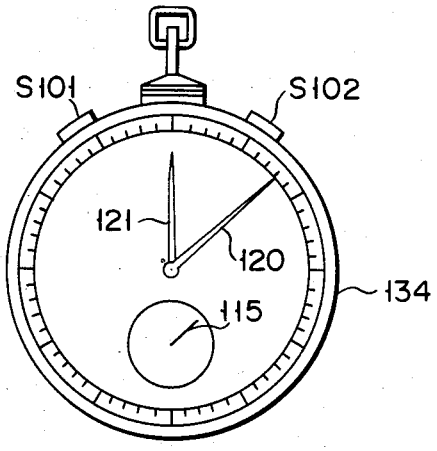
FIG. 5 is a front view of the outer appearance of the stop watch shown in FIG. 4.
Figure 4:
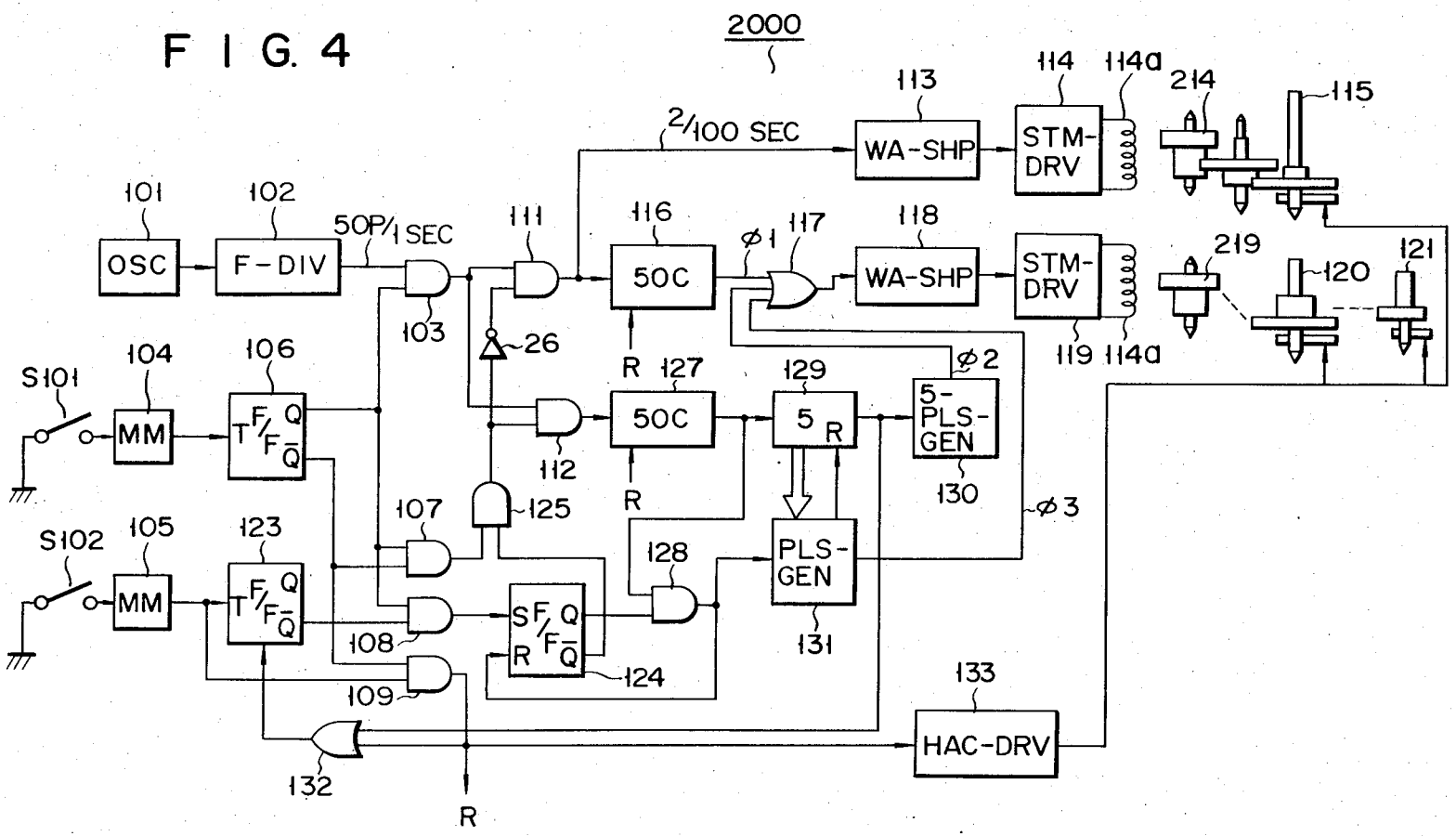
FIG. 4 is a circuit diagram of a stop watch according to another embodiment of the present invention.
Figure 6:
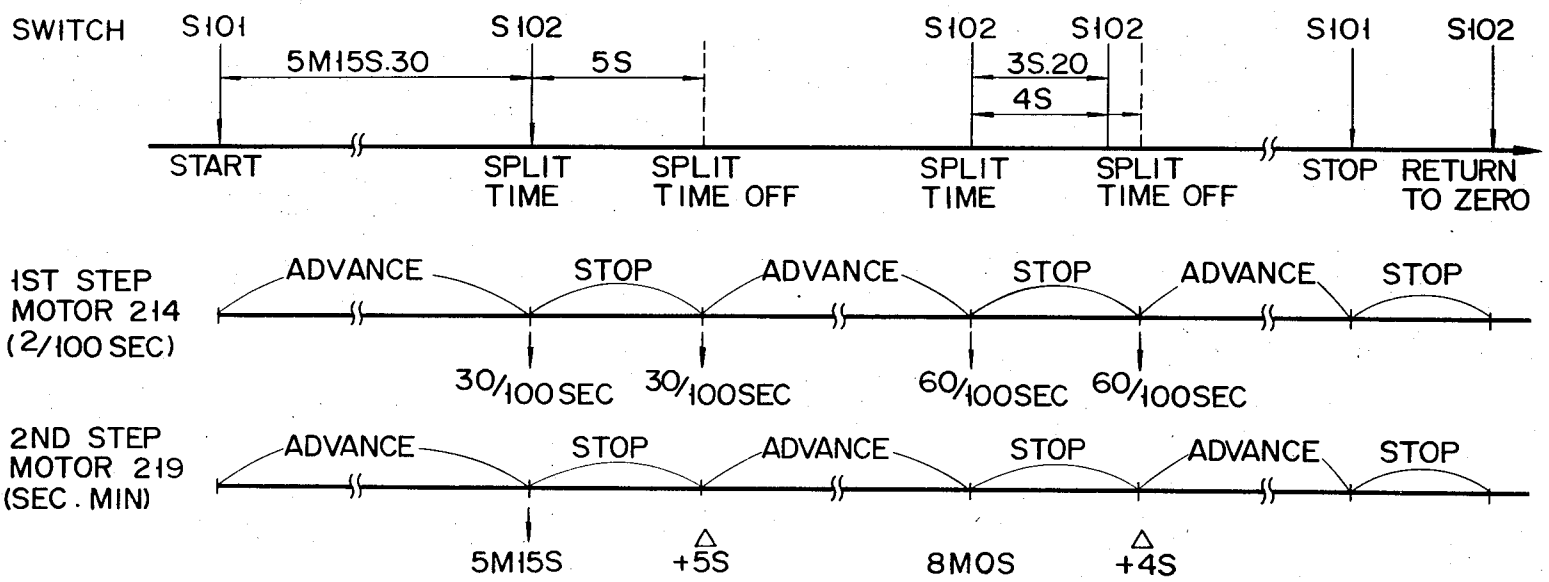
FIG. 6 is a view for explaining the operation of the stop watch shown in FIGS. 4 and 5.

In this case, however, when the hands of the conventional stop watch are stopped at each split time and are started again, if a quick-shift pulse is supplied to the stepping motor, the stepping motor is overloaded and may sometimes be damaged. If a split time is displayed for a long period of time, it prolongs the quick-shift time of the hands, and a next split time cannot thus be measured during this quick-shift time. FIGS. 4 to 6 show stop watch 2000 according to a second embodiment, wherein these problems are reduced. When stop watch 2000 is used as in the embodiment shown in FIGS. 1 to 3, it serves as a very convenient stop watch.

Referring to FIG. 4, oscillator circuit 101 oscillates a clock signal having a predetermined frequency. A signal from circuit 101 is frequency-divided by frequency-dividing circuit 102 to a signal having a frequency of, for example, 50 Hz (50 p/s), and is supplied to AND gate 103. Reference numerals S101 and S102 denote manual switches provided on the side of stop watch 2000. Switch S101 serves as a start/stop switch, and switch S102 serves as a split/split cancel switch. Operation signals from switches S101 and S102 are supplied to corresponding one-shot (multivibrator) circuits 104 and 105, to generate one-shot pulse signals. The pulse signal from circuit 104 is supplied to a T input terminal of binary flip-flop 106, to invert its output state. The $\overline{Q}$ output signal (start signal) of flip-flop 106 is supplied to AND gates 103, 107, and 108, as a gate control signal. The Q output signal (stop signal) of flip-flop 106 is supplied to AND gate 109, as a gate control signal. Gate 103 supplies the 50-Hz signal (50 p/s) from frequency-dividing circuit 102 to AND gates 111 and 112. The 50-Hz signal passing through gate 111 is supplied to waveform shaping circuit 113. The signal waveform-shaped by circuit 113 is supplied to stepping motor driving section 114, to allow 2/100 second hand axis 115 to rotate in units of minimum time measurement. The 50-Hz signal output from gate 111 is supplied to fifty count counter 116. Gate 111 supplies 1-Hz signal $\phi 1$ to OR gate 117 every one second ($2/100 \times 50 = 1$). The 1-Hz signal which passed through gate 17 is supplied to waveform shaping circuit 118. The 1-Hz signal waveform-shaped by circuit 118 is then supplied to stepping motor driving section 119, so as to cause second hand axis 120 and minute hand axis 121 to rotate through the same gear train. A pulse signal output from one-shot circuit 105 by depression of switch S102 is supplied to a T input terminal of binary flip-flop 123, to invert its output state. The Q output signal from flip-flop 123 is supplied to AND gate 107, as a gate control signal. On the other hand, the $\overline{Q}$ output signal from flip-flop 123 is supplied to AND gate 108, as a gate control signal. An output signal from gate 108 is supplied to an S input terminal (set terminal) of flip-flop 124, as a set signal. A signal output from AND gate 125 receiving the signal from gate 107 is supplied to AND gate 112 directly, as well as to AND gate 111, through inverter 126, thereby selectively enabling/disabling gates 111 and 112. Therefore, the 50-Hz signal is supplied to fifty count counter 116 or 127, through gate 111 or 112, in accordance with the output state of gate 125. Fifty count counter 127 supplies a carry signal to AND gate 128 and five count counter 129 every one second. Counter 129 supplies a carry signal to five-pulse generating circuit 130 every five seconds. Upon reception of the carry signal from counter 129, circuit 130 supplies five pulses $\phi 2$ having a frequency of 116 Hz to OR gate 117. Pulse generating circuit 131 monitors the number of counts of counter 129. Upon reception of a pulse signal from AND gate 128, circuit 131 supplies pulses $\phi 3$ of the same number, i.e., corresponding to the content of counter 129 and having a frequency of 116 Hz, to OR gate 117. Then, pulse generating circuit 131 clears the count of counter 129 to "0". The carry signal, which is supplied from counter 129 every five seconds, is input, as a reset signal, to the R input terminal (reset terminal) of binary flip-flop 123 via OR gate 132.

When the $\overline{Q}$ output signal of flip-flop 106 is at "H" level (high level) and switch S102 is depressed, a pulse signal output from one-shot circuit 105 is supplied to OR gate 132 and heart cam driving circuit 133, through AND gate 109. The signals from counter 129 and gate 109 that are supplied to the R input terminal of flip-flop 123, through gate 132, can reset, (i.e., set to "L" (low level), the Q output signal of flip-flop 123, as they priority over other signals. The output signal (R) of AND gate 109, is supplied to fifty count counters 116 and 127, as an R signal, to clear the count content thereof to 0. Heart cam driving circuit 133 receives a signal from gate 109, to set hands of 2/100 second hand axis 115, second hand axis 120, and minute hand axis 121 to their initial positions, i.e., at 0, through their heart cam mechanisms. FIG. 5 shows the outer appearance of the stop watch shown in FIG. 2. Manual switches S101 and S102 are provided on the side of case 134, to be capable of being depressed. 2/100 second hand 135 is mounted on axis 115, and second hand 136, second hand axis 120, and minute hand 137 are coaxially mounted on axis 121.

OPERATION OF STOP WATCH

The operation of the stop watch shown in FIGS. 4 and 5 will now be described with reference to FIG. 6.

Assume that manual switch S101 is depressed, to start measurement. A pulse signal is output from one-shot circuit 104, to set the Q output signal of binary flip-flop 106 to "H" level. This enables AND gate 103, and a 50-Hz signal from frequency-dividing circuit 102 is input to waveform shaping-circuit 113 and fifty count counter 116 through AND gates 103 and 111 (in this case, AND gate 112 is disabled). The 50-Hz (2/100 second) signal input to circuit 113 drives 2/100 second hand axis 115 through stepping motor driving section 114. At the same time, the 50-Hz signal input to counter 116 becomes 1-Hz (1 second) signal $\phi 1$, is passed through OR gate 117, and drives axes 120 and 121 of the same system through stepping motor driving section 119, thereby performing time measurement. Therefore, as shown in FIG. 6, after the stop watch is started, first stepping motor 214 for axis 115 and second stepping motor 219 for axes 120 and 121 are driven simultaneously during a time period of, for example, 5'15"30 (i.e., until split switch S102 is depressed). Now assume that switch S102 is depressed 5'15"30 after the start. A pulse signal is then output from one-shot circuit 105, and the Q output signal of flip-flop 123 is set to "H" level. This in turn sets the output of AND gate 107 to "H" level, to disable AND gate 111, thereby stopping axes 115, 120, and 121. At this time, hand 135 indicates "30, and hands 136 and 137 indicate 5'15. The person in charge of time measurement can then recognize the split time and write it down on a sheet of paper or the like. In this case, the 50-Hz signal is input to fifty count counter 127 through AND gate 112, in order to supply 1-Hz (1 second) signals to counter 129. Counter 129 counts five 1-Hz signals and supplies a single pulse signal to five-pulse generating circuit 130 and OR gate 132 (five seconds after). Upon reception of the pulse signal, circuit 130 supplies five short pulse signals $\phi 2$ (16 Hz) to waveform-shaping circuit 118 through OR gate 117. The quick-feed pulse $\phi 2$ from circuit 118 allows hands 136 and 137 to move through stepping motor driving section 119, so as to compensate for the 5 second delay. Note that quick feed pulse $\phi 2$ and output $\phi 1$ of counter 116 have different phases, so that they are not superposed on each other. The pulse signal from counter 129, which has passed OR gate 132 simultaneously with the signal which has passed generating circuit 130, resets binary flip-flop 123, and sets its Q output signal to "L" level. The output signals of AND gates 107 and 125 are then also set to "L" level, to enable AND gate 111 and to disable AND gate 112 again, respectively. As a result, the 50-Hz signals from frequency-dividing circuit 102 and gate 103 are supplied to waveform-shaping circuit 113 and counter 116, respectively. In the same manner as described above, when five seconds have elapsed, the 50-Hz (2/100 second) signal input to circuit 113 causes hand 135 to be moved from the same position through driving section 114. At the same time, the 50-Hz signal input to counter 116 becomes a 1-Hz signal and passes OR gate 117, so as to allow hands 136 and 137 to move, through circuit 118 and driving section 119, to catch up with the present time being measured by the $\phi 2$ signal. In this manner, axes 115, 120 and 121 are stopped for five seconds after the split time measurement. Thereafter, axes 120 and 121 are moved quickly to compensate for the five second delay, and resume movement from 5'20. Axis 115 resumes movement from the original position of "30. Since counter 129 is a five count counter, the split time display mode is automatically canceled after five seconds. When the automatic cancel time is to be changed, five count counter 129 may be replaced by an arbitrary n count counter.

A case will be described wherein the split time display mode is canceled before five seconds elapse. Assume that split switch S102 is depressed at 8'00"60. Then, in the same manner as described above, axis 115 is stopped, to indicate "60, axes 120 and 121 are stopped, to indicate 8'00, and the person in charge of time measurement reads the indicated split time. Thereafter, since axes 115, 120, and 121 do not need to be kept stopped any longer and are returned to original time measuring as soon as possible, switch S102 is depressed again, to cancel the split time display mode. For example, assume that switch S102 for split time display is depressed 3"20 after 8'00"60. A pulse signal from one-shot circuit 105 then sets the "H" level $\overline{Q}$ output signal of binary flip-flop 123 to "L" level, and sets the $\overline{Q}$ output signal therefrom to "H" level. The output signal of AND gate 108 is set to "H" level, flip-flop 124 is set, the Q output signal of flip-flop 124 is set to "H" level, and AND gate 128 is enabled. A 1-Hz (1 second) signal from fifty count counter 127 passes through gate 128 and is supplied to both flip-flop 124 and pulse generating circuit 131. As shown in FIG. 6, even if switch S102 is depressed 3"20 after 8'00"60, counter 127 does not output a 1-second signal until 4 seconds have elapsed, so that the split time display mode is canceled after 4 seconds (delayed by 0"80). Circuit 131 receives a signal from gate 128, supplies four quick feed pulses (higher than 5 Hz) $\phi 3$ corresponding to the count (in this case, 4 pulses) of counter 129 to OR gate 117, and clears the count of counter 129 to 0. Note that signal $\phi 3$ and $\phi 1$ have different phases from each other. The four quick feed pulses passing OR gate 117 drive axes 120 and 121 through waveform-shaping circuit 118 and stepping motor driving section 119, so as to compensate for the 4 second delay. At the same time, flip-flop 124 is reset by an output signal from AND gate 128, 4 seconds after the split time display mode, and its Q and $\overline{Q}$ output signals are set to "H" level and "L" level, respectively. Thus, AND gate 128 is disabled and the output therefrom is stopped. In this case, since an output signal from gate 107 is at "L" level, an output signal from AND gate 125 is also set to "L" level, AND gate 111 is enabled, AND gate 112 is disabled, and a 50-Hz signal received from frequency-dividing circuit 102, through AND gate 103, is supplied to circuit 113 and fifty count counter 116. In the same manner as described above, the 50-Hz (2/100 second) signal input to circuit 113 drives axis 115, through stepping motor driving section 114, from the same position, after 4 seconds. At the same time, the 50-Hz signal input to counter 116 becomes a 1-Hz signal. The 1-Hz signal passes OR gate 117 and drives axes 120 and 121, which have been already moved quickly, by signal $\phi 3$, through driving section 119, in accordance with the present time measurement. In this manner, axes 115, 120, and 121 are stopped for 4 seconds after setting the split time display mode. Thereafter, axes 120 and 121 are fed quickly, to compensate for the 4 second delay, and resume movement of their respective hands from 8'04, and axis 115 resumes movement of its hand from the original position of "60. Therefore, although the split time display mode is automatically canceled after 5 seconds, switch S102 can be depressed even before 5 seconds elapse, so as to cancel the split time display mode at an earlier stage. In this case, fractions below 1 second are rounded up, i.e., a value between 1 and 2 seconds is rounded up to 2 seconds, a value between 2 and 3 seconds is rounded up to 3 seconds, and a value between 3 and 4 seconds is rounded up to 4 seconds, and the hands then resume movement. Now assume that switch S101 is depressed a final time. Then, an output pulse from one-shot circuit 104 sets the Q output signal of binary flip-flop 106 to "L" level, so that AND gate 103 is disabled, and the hands are stopped. Subsequently, when manual switch S102 is depressed, an output pulse from one-shot circuit 105 passes through AND gate 109, resets fifty count counters 116 and 127, axes 115, 120, and 121, and binary flip-flop 123, thereby setting the stop watch to the initial state.

In the above embodiment described with reference to FIGS. 4 to 6, there was shown only a configuration which is related to a function for stopping the hands for a predetermined period of time when split time display manual switch S102 is depressed. However, up/down counter 18, memory 23, and waveform shaping circuit 25 for rotating the stepping motor in the reverse direction, which are shown in FIG. 1, and other necessary functions can be added, so that a split time can be displayed after stopping the stop watch as per the embodiment in FIG. 1.

The present embodiments exemplify only a stop watch function. However, this stop watch function can be incorporated in an analog type wrist watch for indicating the time. In this case, the hour, minute, and second hands of the wristwatch for indicating the time can be used as minute, second, and 1/100 or 1/10 second hands, respectively.

What is claimed is:

1. A stop watch comprising:

a stepping motor;

a hand drive mechanism coupled to said stepping motor for driving hands of the stop watch;

an oscillator for producing a reference signal;

a stepping motor driving circuit for frequency-dividing the reference signal so as to produce a stepping motor driving signal for driving said stepping motor;

a start/stop control circuit for controlling a supply of the stepping motor driving signal output from said stepping motor driving circuit to said stepping motor;

a split time measurement switch for obtaining a plurality of split times by depressing the same a plurality of times while said stepping motor is driven under the control of said start/stop control circuit;

time measurement means for measuring a time interval between successive split time points at which said split time measurement switch is depressed, to obtain time interval data;

time interval data memory means for storing the time interval data measured by said time measurement means; and reproducing means for driving said stepping motor for a time period corresponding to the time interval data stored in said time interval data memory means while said stepping motor is stopped under the control of said start/stop control circuit, and for reproducing a split time point at which said split time measurement switch is depressed.

2. A stop watch as claimed in claim 1, wherein said reproducing means includes:

detecting means for detecting that said split time measurement switch is depressed while said stepping motor is stopped, so as to reproduce the split time in response to a detection signal obtained by said detecting means.

3. A stop watch as claimed in claim 1, wherein said reproducing means includes:

waveform-shaping means for producing a reversing signal capable of rotating said stepping motor in a reverse direction, so as to supply the reversing signal therefrom to said stepping motor and reproduce the split time.

4. A stop watch as claimed in claim 1, wherein said time measurement means includes:

memory means for storing a first depression of said split time measurement switch after commencement of said stop watch, so as to start time measurement upon the first depression of said switch in response to an output from said memory means.

5. A stop watch as claimed in claim 1, wherein said time measurement means further includes:

means for transferring the time interval data to said time interval data memory means upon depression of said split time measurement switch.

6. A stop watch as claimed in claim 1, wherein said reproducing means includes;

transfer means for transferring the time interval data stored in said time interval memory means to said time measurement means;

reverse rotating means for rotating said stepping motor in the reverse direction after the transfer by said transfer means; and, stopping means for stopping the reverse rotation of said stepping motor when said stepping motor is rotated in the reverse direction for a time period corresponding to the time interval data transferred to said time interval measurement means by said reverse rotating means.

7. A stop watch as claimed in claim 6, wherein said time measurement means is measurement means capable of up-/down-counting, said stop watch further comprises subtracting means for performing subtraction during the reverse rotation of said stepping motor, and said stopping means includes zero-detecting means for stopping the reverse rotation of said stepping motor when the content of said measurement means becomes zero by means of said subtracting means.

8. A stop watch as claimed in claim 1, wherein said time interval data memory means includes a memory for storing the time interval, and address designating means for designating an address of said memory, the contents of address designating means are designated in different addresses of said memory every time said split time measurement switch is depressed, and said time interval data is stored in an address region of said memory designated by said address designating means.

9. A stop watch as claimed in claim 1, wherein said reproducing means includes;

means for clearing said hand drive mechanism and returning the same to an initial position; and, means for driving said stepping motor from the initial position of said hand drive mechanism returned by said clearing means to a position at which said split time measurement switch has been depressed.

10. A stop watch as claimed in claim 1, wherein said stepping motor includes;

a first stepping motor for driving a hand indicating a minimum time unit of measurement data; and, a second stepping motor for driving a hand indicating a time unit higher than the minimum unit indicated by said hand of said first stepping motor.

11. A stop watch as claimed in claim 1, wherein said stepping motor driving circuit includes;

stopping means for stopping the driving of said stepping motor when said split time measurement switch is depressed, stop time measurement means for measuring a stop time during which said stepping motor is stopped by said stopping means; and, restart means for re-driving said stepping motor when the stop time measured by said stop time measurement means reaches a predetermined value.

12. A stop watch as claimed in claim 11, wherein said restart means includes quick-shift means for quick-shifting said stepping motor for a time period corresponding to the stop time measured by said stop time measurement means.

13. A stop watch as claimed in claim 12, wherein said stepping motor includes;

a first motor for driving a hand indicating a minimum time unit of measurement data; and, a second stepping motor for driving a hand indicating a time unit higher than the minimum time unit, and said quick-shift means drives said second stepping motor so as to perform quick-shifting.

* * * * *